US005411833A

United States Patent [19]

Swidler

[11] Patent Number: 5,411,833

[45] Date of Patent: May 2, 1995

[54] ELECTROPHOTOGRAPHIC TONER AND DEVELOPER COMPOSITIONS AND COLOR REPRODUCTION PROCESSES USING SAME

[75] Inventor: Ronald Swidler, Palo Alto, Calif.

[73] Assignee: Lommtech International Management Corporation, Menlo Park, Calif.

[21] Appl. No.: 16,660

[22] Filed: Feb. 10, 1993

Related U.S. Application Data

[63] Continuation of Ser. No. 780,526, Oct. 18, 1991, abandoned, which is a continuation of Ser. No. 464,896, Jan. 16, 1990, abandoned, which is a continuation-in-part of Ser. No. 356,264, May 23, 1989, Pat. No. 5,069,995, and a continuation-in-part of Ser. No. 355,484, May 23, 1989, abandoned, and a continuation-in-part of Ser. No. 398,460, Aug. 25, 1989, Pat. No. 5,045,425.

[51] Int. Cl.[6] ..... G03G 9/00

[52] U.S. Cl. ..... 430/109; 430/115; 430/137

[58] Field of Search ..... 430/115, 137, 109

[56] References Cited

U.S. PATENT DOCUMENTS

| | | | |
|---|---|---|---|
| 4,155,862 | 5/1979 | Mohn et al. | 430/113 |
| 4,167,503 | 9/1979 | Cipriani | 524/296 |
| 4,357,413 | 11/1982 | Cohen et al. | 430/253 |
| 4,460,672 | 7/1984 | Gruber et al. | 430/110 |
| 4,556,624 | 12/1985 | Gruber et al. | 430/110 |
| 4,564,574 | 1/1986 | Uytterhoeven et al. | 430/115 |
| 4,707,429 | 11/1987 | Trout | 430/115 |
| 4,837,394 | 6/1989 | Alexandrovich et al. | 430/110 |
| 4,879,199 | 11/1989 | Gruber et al. | 430/137 |
| 4,897,332 | 1/1990 | Gibson et al. | 430/115 |
| 4,925,766 | 5/1990 | Elmasry et al. | 430/115 |
| 4,931,506 | 5/1990 | Yu | 525/187 |
| 4,946,753 | 8/1990 | Elmagry et al. | 430/115 X |

FOREIGN PATENT DOCUMENTS

| | | | |
|---|---|---|---|
| 33628 | 3/1985 | European Pat. Off. . | |
| 57-148751 | 9/1982 | Japan | 430/114 |
| 59-87463 | 5/1984 | Japan . | |
| 59-29861 | 7/1984 | Japan . | |
| 010126 | 1/1989 | Japan . | |
| 2-187769 | 7/1990 | Japan . | |
| 1442835 | 7/1976 | United Kingdom . | |

OTHER PUBLICATIONS

Pat. Abstracts of Japan, vol. 13, No. 180 (P-864), Apr. 27, 1989 (Abst. of JP-A-1010261).

English translations of marked portions of pp. 481, 482 and 488 of JP-A-1010261 are included.

*Primary Examiner*—Steve Rosasco

*Attorney, Agent, or Firm*—Corwin R. Horton

[57] ABSTRACT

Toner and liquid developer compositions for use in color electrophotographic processes are described. The developer compositions display high particle-mediated conductivity and charge and thus give rise to a final print of exceptionally high quality. Methods of manufacturing the toner and developer compositions are also disclosed, as are novel charge control agents and processes for using the various compounds and compositions in consecutive multicolor image development.

49 Claims, 4 Drawing Sheets

ELECTROPHOTOGRAPHIC TONER AND DEVELOPER COMPOSITIONS AND COLOR REPRODUCTION PROCESSES USING SAME

CROSS-REFERENCE TO RELATED APPLICATIONS

This application is a continuation of application Ser. No. 07/780,526, filed 18 Oct. 1991, now abandoned, which is a continuation of application Ser. No. 07/464,896, filed Jan. 16, 1990, now abandoned, which is a continuation-in-part of U.S. application Ser. No. 07/356,264, now U.S. Pat. No. 5,069,995, filed 23 May 1989, entitled "STAIN ELIMINATION IN CONSECUTIVE COLOR TONING", Ser. No. 07/355,484, filed 23 May 1989, abandoned, entitled "FINE PARTICLE ELECTROPHOTOGRAPHIC TONER AND DEVELOPER COMPOSITIONS AND PROCESS THEREFOR", and Ser. No. 07/398,460, filed 25 Aug. 1989, now U.S. Pat. No. 5,045,425, entitled "ELECTROPHOTOGRAPHIC LIQUID DEVELOPER COMPOSITION AND NOVEL CHARGE DIRECTORS FOR USE THEREIN". The disclosures of these three application are expressly incorporated by reference herein.

TECHNICAL FIELD

The present invention relates to the field of color electrophotography, and more particularly relates to novel toner and developer compositions for use in color electrophotographic processes. The invention additionally relates to consecutive multicolor image development processes utilizing the novel compositions, which processes give rise to color prints of exceptionally high quality, i.e., having superior image density and resolution with virtually no background or image staining.

BACKGROUND

Preparation of printed images by electrophotographic, or "xerographic", processes involves coating a selected substrate, or xerographic plate (typically comprised of metal, glass or plastic), with a photoconductive insulating material such as selenium, and then providing an electrostatic charge on the photoconductive surface, e.g., by ionization from a corona discharge. A light image is then focused onto the charged surface, which discharges or lowers the potential of the irradiated areas, while leaving the remainder of the surface charged. The electrostatic image so formed is then made visible by application of a suitable developing composition, which may be in either dry or liquid form.

Conventional liquid developer compositions comprise a dispersion of pigment particles in an insulating carrier liquid. Application of such a composition to the substrate carrying the electrostatic image results in migration of charged pigment particles to the substrate surface and deposition thereon in conformance with the electrostatic image. The developed image is then transferred to another substrate such as paper. (In some cases, it is desirable to eliminate the intermediate step of image transfer, i.e., so that the developed image is directly produced upon the final surface; see, e.g., U.S. Pat. No. 3,052,539 to Greig.)

Liquid developers for use in multicolor image development are relatively recent, and are comprised of colorant embedded in a thermoplastic resin core. These "toner" particles are then dispersed in an insulating carrier medium as above. Like compositions used in black-and-white electrophotography, these developer compositions additionally contain charge control agents to control the charge acquired by the toner particles in the insulating liquid.

When a color image is to be produced electrophotographically, the above-described charging, exposure, and development steps are carried out separately in succession for each of the constituent colors of the image using a correspondingly colored toner. In some color printing processes, each of the color images is transferred from the electrophotographic member to a print substrate after development and prior to formation of the next color image. This process, however, requires extremely accurate registration of the successive color images on the substrate to which they are transferred in order to obtain a high-quality composite image.

Another color printing process, and the process currently in use commercially, is a four-color liquid electrophotographic process known as "consecutive color toning" or "consecutive multicolor image development". This process involves: (1) charging a photoconductive (pc) surface; (2) impressing a first latent image on the surface by exposure through a colored transparency; (3) developing the image by contacting the pc with a liquid developer composition of a first color, typically yellow; and (4) discharging the pc surface. The steps are then repeated in sequence, typically using magenta, cyan, and black developer compositions, i.e., the cyclic process is repeated until the colored image is complete.

A significant problem which has been encountered in consecutive color toning is "image" or "character" staining, that is to say, where a second process color overtones the first image in regions where portions of the first image should have been discharged but were not. See, for additional explanation of the problem, R. M. Schaffert, *Electrophotography* (London: Focal Press, 1975), at pp. 184–186.

Many schemes have been advanced to overcome this difficulty. In U.S. Pat. No. 4,701,387 to Alexandrovich et al., for example, the problem of residual toner is discussed. The inventors propose a solution wherein the developed surface is rinsed with a polar liquid after each development step. It is suggested that application of a polar rinse liquid neutralizes and solvates residual counterions deriving from charge control agents and stabilizers present in the liquid developer.

While the Alexandrovich et al. method may be effective in reducing the staining problem, such a multiple washing procedure is time-consuming and unwieldy (it is recommended in the '387 patent that "after each development step and before the next developer is applied, the developed image is rinsed . . . . After rinsing, the rinse liquid is removed from the photoconductive element by drying, wiping or other method . . . "; see col 2, lines 62–67).

U.S. Pat. No. 2,986,521 to Wielicki proposes the use of photoconductive toner particles to permit dissipation of charge applied to a toner layer during exposure of a second or subsequent color image to avoid charge retention in those areas. Such developers, however, may also be sufficiently conductive in the dark to dissipate the charge where it is intended to be retained during a subsequent imaging process, thereby preventing the subsequent image from being developed in those areas. U.S. Pat. No. 3,687,661 to Sato et al. seeks to overcome the problem resulting from retained charge by applying a reverse-polarity charge which neutralizes any charge retained in previously developed regions of the electrophotographic member. Such additional steps, however, not only prolong the processing time required to produce a composite color image, but also add to the complexity of the electrophotographic apparatus.

Other problems frequently encountered in electrophotographic color processes include: background staining, i.e., the appearance of toner in uncharged, non-image areas (a problem which is ubiquitous in zinc oxide and other positive toner systems); poor image resolution (i.e., poor edge acuity); poor image density resulting from insufficient deposition of toner particles in intended image regions; and colorant exposure, in which colorant contained within the resinous toner particles is exposed to the developer solution (as well as to the substrate) and thus affects the chemistry of the particular developer composition.

The invention herein now provides compositions and processes which address and overcome each of the aforementioned problems. First with respect to image staining in multicolor image development, the present toner and developer compositions substantially eliminate the cause of the problem and avoid the time-consuming, multi-step procedures of the prior art. The presently disclosed compositions and processes also enable preparation of a final electrophotographic print of unexpectedly high quality, with respect to both image density and edge acuity. The problems of colorant exposure and background staining are also virtually eliminated as will be described in detail below.

CITATION OF PRIOR ART

R. M. Schaffert, Electrophotography (London: Focal Press, 1975), provides a comprehensive overview of electrophotographic processes and techniques. Representative references which relate to the field of color electrophotography, specifically, include U.S. Pat. No. 3,060,021 to Greig, U.S. Pat. No. 3,253,913 to Smith et al., U.S. Pat. No. 3,285,837 to Neber, U.S. Pat. No. 3,337,340 to Matkan, U.S. Pat. No. 3,553,093 to Putnam et al., U.S. Pat. No. 3,672,887 to Matsumoto et al., U.S. Pat. No. 3,687,661 to Sato et al., and U.S. Pat. No. 3,849,165 to Stahly et al. References which describe electrophotographic toners and developers include U.S. Pat. No. 4,659,640 to Santilli (which describes a developer composition containing dispersed wax), U.S. Pat. No. 2,986,521 to Wielicki, U.S. Pat. No. 3,345,293 to Bartoszewicz et al., U.S. Pat. No. 3,406,062 to Michalchik, U.S. Pat. No. 3,779,924 to Chechak, and U.S. Pat. No. 3,788,995 to Stahly et al.

References which relate to charge control agents, also sometimes referred in this and related applications as "charge directors", include U.S. Pat. No. 3,012,969 to van der Minne et al. (polyvalent metal organic salts in combination with an oxygen-containing organic compound), U.S. Pat. No. 3,411,936 to Rotsman et al. (metallic soaps), U.S. Pat. No. 3,417,019 to Beyer (metallic soaps and organic surface active agents), U.S. Pat. No. 3,788,995 to Stahly et al. (various polymeric agents), U.S. Pat. No. 4,170,563 to Merrill et al. (phosphonates), U.S. Pat. No. 4,229,513 (quaternary ammonium polymers), U.S. Pat. No. 4,762,764 to Ng (polybutene succinimide, lecithin, basic barium petroleum sulfonates, and mixtures thereof), and *Research Disclosure,* May, 1973, at page 66.

U.S. Pat. No. 4,701,387 to Alexandrovich et al., discussed in the preceding section, and U.S. Pat. No. 3,337,340 to Matkan, are relevant insofar as each of these references relates to the problem of image staining in consecutive color toning.

SUMMARY OF THE INVENTION

Accordingly, it is a primary object of the present invention to provide new and improved electrophotographic toner and developer compositions which overcome the above-mentioned deficiencies of the prior art.

It is another object of the invention to provide compositions and processes for obtaining a high resolution, high density electrophotographic color print with a minimum of image and background staining.

It is still another object of the invention to provide processes for manufacturing such toner and developer compositions.

It is a further object of the invention to provide an improved consecutive color toning process using the novel toner and developer compositions.

It is still a further object of the invention to provide novel charge control agents for use in conjunction with the presently disclosed compositions and processes.

Additional objects, advantages and novel features of the invention will be set forth in part in the description which follows, and in part will become apparent to those skilled in the art upon examination of the following, or may be learned by practice of the invention.

The above objects are accomplished in accordance with the present invention by providing a toner for incorporation into an electrophotographic liquid developer composition, the toner comprising: (a) particles of a colored resinous phase having specific surface ion exchange sites available for complexation with certain metal salts; (b) a charge control agent comprising such a metal salt and (c) an antistain agent, wherein the the components are selected such that upon dispersion of the toner in an insulating carrier liquid, the equilibrium of complexation between the particles and the charge control agent is such that virtually all of the charge control agent is associated with the particles. This latter feature yields a developer composition of exceptionally high particle-mediated conductivity and charge, which along with its other attributes in turn (1) significantly reducing image staining and (2) eliminating the need for intermediate processing steps upon use of the composition in consecutive color toning, i.e., to remove residual toner in unwanted areas.

In another aspect of the invention, a developer composition is provided which comprises the above-mentioned toner dispersed in a selected insulating carrier liquid. As noted above, the developer composition displays exceptionally low continuous phase spacing conductivity.

Other aspects of the invention include processes for manufacturing the above-described toner and developer compositions. These processes enable the manufacture of extremely fine particle toners which can be used to create a final image of exceptionally high quality. In addition, either positive or negative toners can be prepared using the compositions and methods of the invention, as will be described.

In still other aspects of the invention, consecutive color toning processes are provided which utilize the novel toner and developer compositions. The processes involve repeating the following sequence of steps with the different color developers: charging a pc surface; impressing a first latent image on the surface; developing the image by application of the novel liquid developer composition; and then discharging the pc surface. Unlike the prior art consecutive color toning processes, however, the method of the invention involves no intermediate processing steps, i.e., rinsing, drying, or the like, while nevertheless providing a high quality, high resolution final image with a minimum of image and background staining.

BRIEF DESCRIPTION OF THE DRAWINGS

FIG. 3 represents a developed image obtained with the toner and developer compositions of the invention wherein no image staining is apparent.

DETAILED DESCRIPTION OF THE INVENTION

Definitions

Figure 1:
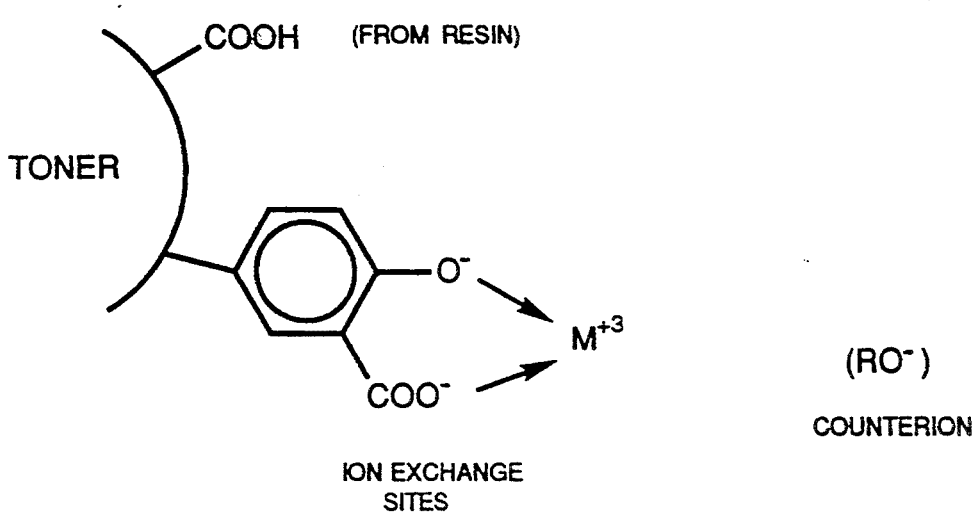
FIGS. 1 and 2 illustrate the charged toner particle complexes present in the developer compositions of the invention.

"Toner" as used herein is intended to denote the charged toner particle, i.e., the charged toner particle/charge control agent complex which is to be dispersed in a carrier liquid to give a developer composition. The "toner" thus includes both (a) the particles of resin containing colorant as well as (b) the selected charge control agent.

By "developer composition" as used herein is meant a dispersion of the toner in the selected insulating carrier liquid. The developer composition may contain a number of additional components as will be described below.

"Particle-mediated" conductivity and charge is intended to mean that virtually all of the conductivity and charge in a developer composition derives from the charged toner particles and not from free, unassociated salts which may be present in solution (i.e., from unassociated charge control agent or other ionizable species). Compositions formulated with the toner of the invention display very high particle-mediated conductivity and charge and very low continuous phase conductivity.

"Consecutive color toning" as used herein is intended to mean an electrophotographic development process involving repetition of charging and development steps with more than one color (as outlined in the Background Section above) so as to provide a multicolor final image. The process is also sometimes referred to herein as "consecutive multicolor image development".

By "incompatible" as used herein to describe the separate, solid phase that is preferably incorporated into the toner during manufacture is meant: (1) substantially immiscible with the resinous phase of the toner, substantial immiscibility in turn implying a tendency not to blend or mix (two "substantially immiscible" materials will tend to disperse freely in a given solvent, rather than tending to aggregate); and (2) insoluble in the hydrocarbon medium of the liquid developer composition, i.e., having a solubility of less than about 50 ppm, more preferably less than about 10 ppm, therein.

By "color blindness" applicants intend to denote a developer composition whose chemistry and electrophotographic properties are independent of the particular colorant used. In order to ensure color blindness, exposure of the colorant contained within the resinous phase of the toner particles must be substantially prevented.

"Background staining" is a problem which can arise in any electrophotographic process. As used herein the term has its art-recognized meaning and refers to the problem wherein toner appears in unintended, uncharged, non-image areas.

"Image staining" is a problem which is specific to consecutive color toning, and similarly has its art-recognized meaning as used herein. The problem involves overtoning by a second or subsequent process color of an earlier color image in regions where portions of the earlier image should have been discharged but were not. "Image staining" is also sometimes referred to herein and in the art as "character staining".

By "antistain" agents as used herein applicant intends to include anionic, cationic, amphoteric and nonionic surfactants which are substantially immiscible with the resinous phase of the toner particles. As will be described in detail herein, such compounds address and significantly reduce the problem of image staining in consecutive color toning.

Toner

A primary focus of the present invention is on novel toner compositions which provide a number of important and distinct advantages. That is, the toner compositions of the invention are useful for formulating a liquid developer in which conductivity and charge are both substantially particle-mediated, in turn (1) enabling one to carry out consecutive color toning without the intermediate processing steps required by prior art systems, e.g., rinsing, drying, etc.; (2) giving rise to a final image in which virtually no image or background staining is apparent; and (3) significantly enhancing the density of the final image. In addition, using the methods and compositions of the invention, toner may be processed to give extremely fine yet "color-blind" particles, again enhancing the overall quality of the final image and enabling the development of very high-speed electrophotographic equipment.

The toner composition of the invention includes two basic components: (a) particles of a colored resinous phase; (b) a charge control agent; and (c) an antistain agent. The resinous particles are prepared so that specific ion exchange sites are present on the particle surface, these sites in turn available for complexation with the selected metal salt which will serve as the charge control agent. It will be appreciated by those of skill in the art that any number of metal salts may be used as the charge control agent, and that similarly the surface ion exchange sites may derive from a variety of chemical species. However, the metal salt and the ion exchange sites are to be selected such that the equilibrium of complexation between the charge control agent and the particles heavily favors formation of the charged complex upon dispersion of the components in a carrier liquid, i.e., to provide a liquid developer composition as will be described. By "heavily favoring" complexation, applicant intends that virtually all of the charge control agent used will be present in complexed form, i.e., there will be substantially no "unassociated" charge control agent. Preferably, the ion exchange sites and the metal salt are selected so that upon dispersion in a carrier liquid, greater than about 70 wt. %, more preferably greater than about 85 wt. %, most preferably greater than about 95 wt. %, of the charge control agent used will be present in complexed form.

The aforementioned equilibrium of complexation, deriving from proper selection of components for the toner, enables preparation of a liquid developer composition in which (1) virtually all of the solution's conductivity and charge derives from the toner particles, (2) the toner is highly charge-stabilized, i.e., will retain charge over a prolonged period of time, and (3) the toner particles are themselves highly charged. As emphasized throughout this application, these features yield a final image of exceptionally high quality, i.e., with respect to image density, edge acuity, and the like, and also enable use of the toner in a consecutive color process without need for intermediate processing steps which have heretofore been necessary to remove residual toner in unwanted, "non-image", areas.

In a preferred embodiment, the surface ion exchange sites derive from the hydroxy and carboxy moieties of a first ortho-hydroxy aromatic acid bound to the particle. Suitable ortho-hydroxy aromatic acids include those described in parent application Ser. No. 07/398,460, now U.S. Pat. No. 5,045,425 as well as other ortho-hydroxy aromatic acids which may be monomeric, oligomeric or polymeric. Examples of specific ortho-hydroxy aromatic acids useful to provide the surface ion exchange sites include salicylic acid and derivatives thereof. By "derivatives" of salicylic acid applicants intend to include salicylic acid substituted with one to four, typically one to two, substituents independently selected from the group consisting of lower alkyl (1–6C), lower alkoxy (1–6C), halogen, amino, hydroxy, nitro and sulfonate. The particular identity of the ortho-hydroxy aromatic acid used to provide surface ion exchange sites is not, however, critical; it suffices that a hydroxy and a carboxy moiety be proximal on the particle surface so as to act together in chelating a single metal ion. (See, for example, A. E. Martell et al., *Critical Stability Constants,* vol. 3 (New York: Plenum Press). It should also be noted that neutral toners, e.g., toners comprised of ethylene vinyl alcohol, can be made stable and used herein, by binding the toner particles to an ortho-hydroxy aromatic acid in this way.

The second component of the toner, as noted above, is a charge control agent which comprises a metal salt. Again, any number of metal salts may be chosen for use herein so long as the equilibrium of complexation favors formation of the charged toner particle/charge control agent complex. Preferred metal salts, however, include as a counterion the anion of a second ortho-hydroxy aromatic acid which may or may not be identical to the first ortho-hydroxy aromatic acid described above. In general, the second ortho-hydroxy aromatic acid will be chosen from the same class of compounds as those appropriate for the first ortho-hydroxy aromatic acid. One example of a particularly preferred counterion is diisopropyl salicylate (DIPS).

In the preferred embodiment, the charge control agent will additionally contain an ionized base moiety $RO^-$. In such a case, the charge control agent may be represented by the formula $(RO^-)_xM^{+n}(AA^-)_y$ in which M is a metal atom, $AA^-$ represents the anion of the second ortho-hydroxy aromatic acid, and R is selected from the group consisting of R'CO—, $C_1$–$C_{15}$ alkyl, and a 1–3 ring aryl moiety optionally substituted with 1–6 lower alkyl substituents, where R' is $C_1$–$C_{14}$ alkyl, n is 2, 3 or 4, and x and y are integers the sum of which, clearly, is n. (Charge control agents defined by the formula are believed to be novel and indeed represent an additional aspect of the present invention.) In one particularly exemplary embodiment, $AA^-$ is DIPS, R is $C_{10}H_{21}CO$— (i.e., R' is $C_{10}H_{21}$), n is 3, x is 1 or 2, and y is 1 or 2.

The charged toner particle complex which results from the combination of (1) a particle having surface ortho-hydroxy and carboxy moieties, and (2) the aforementioned charge control agent, may thus be represented by the structural formula of FIG. 1 (in which the illustrated metal is trivalent). It may be seen from the figure that the toner is, in a sense, "metallized" in that the metal ion is bound to, or associated with, the particle surface. As illustrated, the toner is also positively charged and can thus be used to make a positive liquid developer system, i.e., one that is useful for developing negatively charged images. (As will be explained below, negative systems can also be manufactured using the same components.)

It may be inferred from the above that the metal atom of the charge control agent may be divalent, trivalent or tetravalent, with trivalent metals most preferred. As explained in parent application Ser. No. 398,460, now U.S. Pat. No. 5,045,425, previously incorporated by reference herein, trivalent metal atoms will give rise to the highest degree of charge stabilization when used in conjunction with ortho-hydroxy aromatic acids (see Schemes 1 and 2 therein). A particularly preferred metal is aluminum.

It may also be inferred from the above that the charge control agent preferably includes one or two basic moieties $RO^-$. The inventor herein has found by working with salicylic acid itself, i.e., salicylic acid unassociated with toner, and with various aluminum salts including $Al(DIPS^-)_3$, $Al(C_{10}H_{21}COO^-)(DIPS^-)_2$, and $Al(C_{10}H_{21}COO^-)_2(DIPS)$, that the basic moiety significantly enhances the equilibrium of complex formation and thus results in (1) a charge-stabilized toner and (2) a developer composition of low "continuous phase'-'—i.e., particle-mediated—conductivity and charge.

It is additionally preferred that the toner comprise a separate, solid incompatible phase as described in parent application Ser. No. 355,484, abandoned. As explained in that application, incorporation of an incompatible phase into a toner composition during manufacture eliminates many of the problems inherent in the compositions of the prior art, and provides a number of advantages. For example, the incompatible phase enables preparation of much finer particles, which ultimately result in a better developer dispersion and a much higher quality final image; the incompatible phase also ensures "color blindness" of the toner in that colorant exposure on the surface of the toner particle is substantially prevented. As explained above, color blindness of a toner is desirable to ensure that the differently colored developers will display chemistry and electrophotographic properties which are independent of the colorant.

Generally, the incompatible phase will be "oleophilic". The term "oleophilic" as used herein has its art-accepted meaning, i.e., it is intended to denote a class of substances which are compatible with or soluble in nonpolar organic liquids. (Oleophilicity can also be defined in terms of a partition coefficient. Preferably, the oleophilic materials used herein have an n-octane:-water partition coefficient of at least 2, more preferably at least 3° ) This is in contrast to the preferred resins for use in making the toner, which, relative to the materials selected for the incompatible phase and the carrier liquid, are "oleophobic", i.e., tending to be more compatible with or soluble in aqueous materials.

The incompatible phase may comprise any material which can be incorporated into the toner particles using the above-described process, and which will result in a separate, solid phase, i.e., a phase that is resin-nonmiscible and thus distinct from the remaining, resinous phase of the toner particle. It is preferred that the incompatible phase, like the resinous phase, be of a material that does not swell in the carrier liquid. Particularly preferred materials for use as the incompatible phase are waxes such as carnauba wax, beeswax, candelilla wax, amide waxes, urethane-modified waxes (e.g., Petrolite WB-type), montan wax, Carbowax (Union Carbide), paraffin waxes, long-chain petroleum waxes, and other waxes as described in U.S. Pat. Nos. 3,060,021 and 4,081,391, both of which are incorporated herein by reference.

The toner also contains an antistain agent (sometimes referred to herein as an "antistatic agent") to assist in reducing image staining upon use in consecutive color toning. As explained in parent application Ser. No. 07/356,264, now U.S. Pat. No. 5,069,995, image staining in consecutive color toning is believed to result from a residual surface charge (presumably resident on the dielectric toner pile) which remains after each individual exposure step. The antistain agent thus addresses the problem by neutralizing residual surface charge, i.e., by "bleeding" excess charge.

Suitable antistain agents include anionic, cationic, amphoteric or nonionic surfactants.

Anionic surfactants commonly contain carboxylate, sulfonate or sulfate ions. The most common cations in these materials are sodium, potassium, ammonium, and triethanolamine, with an average fatty acid chain length of 12 to 18. Examples of anionic surfactants are long-chain alkyl sulfonates such as sodium lauryl sulfate and alkyl aryl sulfonates such as sodium dodecylbenzene sulfonate.

Cationic surfactants are typically amine salts, quaternary ammonium salts, or phosphonium salts, the compounds containing a hydrophobic moiety such as a hydroxyl, long-chain alkyl, or aralkyl substituent.

Amphoteric agents include, for example, compounds which contain carboxylate or phosphate groups as the anion—e.g., polypeptides, proteins, and the alkyl betaines—and amino or quaternary ammonium groups as the cation, compounds which typically exist in a zwitterionic state.

Non-ionic surfactants include long-chain fatty acids and their water-insoluble derivatives, e.g., fatty alcohols such as lauryl, cetyl and stearyl alcohols, glyceryl esters such as the naturally occurring mono-, di- and triglycerides, fatty acid esters of fatty alcohols and other alcohols such as propylene glycol, polyethylene glycol, sorbitan, sucrose and cholesterol. These compounds may be used as is or modified so as to contain polyoxyethylene groups.

In the preferred embodiment, the antistain agent is a non-ionic surfactant. Examples of particularly preferred non-ionic surfactants for use herein are: (a) ethoxylated derivatives of fatty acids, alcohols and amides; (b) alkyl phosphates and phosphonates and metal salts thereof; (c) homopolymers of ethylene oxide; and (d) copolymers of ethylene and propylene oxide.

The resins and colorants which may be used in formulating the toner may be selected from a wide variety of materials well known in the art of electrophotography. In general, a broader range of both resins and colorants may be used in the present process than in prior art processes. Conventionally, softer resins have been avoided because of problems with aggregation and flocculation. The present invention, however, by virtue of the incompatible phase which is preferably incorporated into the toner, substantially eliminates the problem of aggregation regardless of the resin used. Similarly, because the incompatible phase eliminates the problem of colorant exposure, a wide variety of colorants may now be used as well; the electrical and other chemical and physical properties of the liquid developer composition are no longer affected by the choice of colorant.

Resins useful in liquid electrophotographic developers, generally, are characterized as being insoluble or only slightly soluble in the insulating carrier liquid. They are also typically, although not necessarily, oleophobic" as defined above. Preferred resins should not swell in the carrier liquid, nor, clearly, should they destabilize the developer composition in any way. Examples of suitable resins for use herein include: alkyd and modified alkyd resins cured with polyisocyanate, melamine formaldehyde or benzoguanamine; epoxy ester resins; polyester resins; copolymers of styrene, acrylic and methacrylic esters with hydroxyethyl methacrylate, hydroxyethyl acrylate, hydroxypropyl methacrylate, or the like; other polyacrylates; phenolic resins such as phenol formaldehyde resins and derivatives thereof; ethylene-acrylic acid copolymers; ethylene-vinyl alcohol copolymers and ionomers thereof; styrene-allyl alcohol copolymers; cellulose acetate-butyrate copolymers; and polyethylene and polyethylene copolymers.

The colorants which may be used include virtually any pigments, dyes or stains which may be incorporated in the toner resin and which are effective to make visible the electrostatic latent image. Examples of suitable colorants include: Phthalocyanine blue (C.I. 74160), Diane blue (C.I. 21180), Milori blue (an inorganic pigment equivalent to ultramarine) as cyan colorants; Brilliant carmine 6B (C.I. 15850), Quinacridone magenta (C.I. Pigment Red 122) and Thioindigo magenta (C.I. 73310) as magenta colorants; benzidine yellow (C.I. 21090 and C.I. 21100) and Hansa Yellow (C.I. 11680) as yellow colorants; organic dyes; and black materials such as carbon black, charcoal and other forms of finely divided carbon, iron oxide, zinc oxide, titanium dioxide, and the like.

The optimal weight ratio of colorant to resin in the toner particles is on the order of about 1:1 to 25:1, more preferably about 5:1 to 15:1. The total dispersed material in the carrier liquid typically represents 0.5 to 5 wt. % of the composition.

Toner Manufacture

The toner composition is prepared substantially as described in parent application Ser. Nos. 356,264, U.S. Pat. No. 5,069,995, 355,484, abandoned, and 398,460, U.S. Pat. No. 5,045,425, i.e., using the following basic procedure.

Resin, colorant, an antistain agent, and an ionizable compound selected to provide the aforementioned surface ion exchange sites are admixed at a temperature in the range of about 100° C. to 200° C. A two-roll mill, an extruder, an intensive mixer or the like, is used to ensure complete mixing. The admixture is then comminuted dry, i.e., without addition of liquid, to give intermediate particles typically averaging 30 microns in diameter or less. This dry cominution step is carried out in a jet mill, a hammer mill, or the like. The intermediate particles so obtained are then subjected to liquid attrition in a selected attrition liquid to give the final toner particles. The liquid used for attrition is typically selected from the same class of liquids useful as the carrier liquid for the developer composition, as will be described below.

The ionizable compound, as noted, is selected so as to associate with the toner particle in the insulating carrier liquid of the developer composition and to provide the particle surface with ion exchange sites. This ionizable compound comprises the "first" ortho-hydroxy aromatic acid as described in the preceding section.

It is also preferred that the "incompatible phase" be incorporated into the toner at the initial stage of manufacture, i.e., admixed with the colorant, resin, etc., in step (a). Toner particles obtained using the aforementioned manufacturing process in conjunction with the incompatible phase are very fine, averaging less than 2 microns in diameter, typically 1.5 to 2 microns in diameter, after only 0.5 to 4 hours of liquid attrition. Longer attrition times can give even finer particles, less than 1 micron in diameter. (The inventor herein has established, as described in the Example of parent application Ser. No. 355,484, now abandoned, that omission of the incompatible phase gives much larger, aggregated particles even after attrition periods of as long as 20 to 40 hours.) In addition, as noted in the parent applications, the incompatible phase gives rise to "cohesive" rather than "adhesive" failure during comminution and attrition. In this way, exposure of the colorant on the surface of the toner particle is substantially prevented and the resulting composition is "color-blind" as defined above.

The charge control agent may also be incorporated initially, at the stage of toner manufacture, i.e., with the components as set forth in step (a) of the manufacturing process as described above, or it may be incorporated later, i.e., dispersed into the selected carrier liquid during preparation of the liquid developer composition.

The Developer Composition

A liquid developer composition is prepared from the toner by dispersing the above-mentioned toner components in a carrier liquid. As is well known in the art, such carrier liquids may be selected from a wide variety of materials. The liquid is typically oleophilic as defined above, stable under a variety of conditions, and electrically insulating. That is, the liquid has a low dielectric constant and a high electrical resistivity so as not to interfere with development of the electrostatic charge pattern. Preferably, the carrier liquid has a dielectric constant of less than about 3.5, more preferably less than about 3, and a volume resistivity greater than about $10^9$ ohm-cm, more preferably greater than about $10^{10}$ ohm-cm. Examples of suitable carrier liquids include: halogenated hydrocarbon solvents such as carbon tetrachloride, trichloroethylene, and the fluorinated alkanes, e.g., trichloromonofluoromethane and trichlorotrifluoroethane (sold under the trade name "Freon" by the DuPont Company); acyclic or cyclic hydrocarbons such as cyclohexane, n-pentane, isooctane, hexane, heptane, decane, dodecane, tetradecane, and the like; aromatic hydrocarbons such as benzene, toluene, xylene, and the like; silicone oils; molten paraffin; and the paraffinic hydrocarbon solvents sold under the names Isopar G, Isopar H, Isopar K and Isopar L (trademarks of Exxon Corporation). The foregoing list is intended as merely illustrative of the carrier liquids which may be used in conjunction with the present invention, and is not in any way intended to be limiting.

If the selected charge control agent is not incorporated into the toner during toner manufacture as outlined above, it is incorporated into the developer composition at this stage by dispersion into the selected insulating carrier liquid along with the toner. Similarly, while an antistain agent is optional, although preferred, it may be dispersed into the carrier liquid rather than incorporated into the composition at the stage of toner manufacture. The developer composition may include additional materials as desired and as known in the art, e.g., dispersants, stabilizers, or the like.

Figure 2:
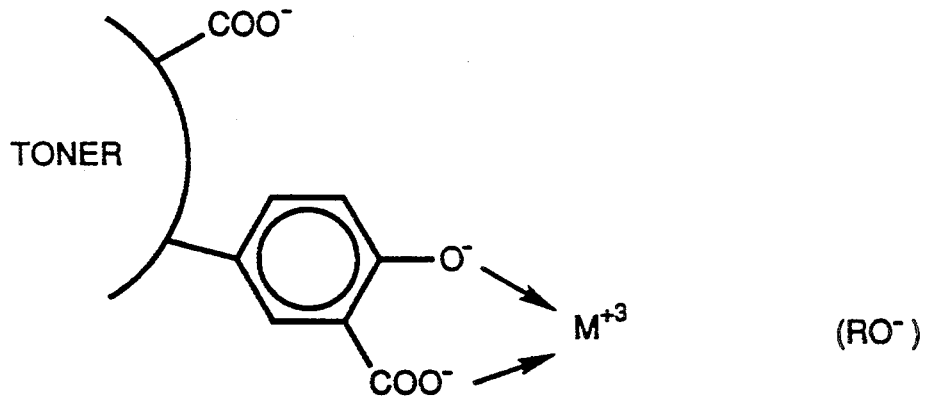

Either a positive or a negative developer composition may be made using the components described herein, depending on the concentration of charge control agent employed. That is, FIG. 1 illustrates preparation of a positive toner particle, i.e., the overall charge on the toner particle is positive. However, if a higher concentration of charge control agent is used (particularly a charge control agent having the formula $M^{+n}(RO)_x$ with M, R, x and n as defined earlier), such that the surface ion exchange sites become saturated, the additional metal salt will begin to ionize free carboxyl groups on the surface of the toner (i.e., carboxyl groups which derive from the resin and not from the associated ortho-hydroxy acid) and a negative toner will be produced. That is, as illustrated by FIG. 2, the overall charge on the toner particle will be negative when non-ion exchange carboxyl groups become ionized with excess charge control agent.

While the toner of the invention has been described as primarily useful for formulating liquid developer compositions, it will be appreciated that these toners can also be used effectively in dry powder systems, i.e., systems which do not involve a carrier liquid or other solvent.

Consecutive Multicolor Image Development

Briefly, a consecutive multicolor image development process (or a "consecutive color toning" process) according to the invention is carried out as follows.

The surface of a photoconductive insulating layer on a relatively conductive substrate is charged, and an initial electrostatic charge pattern (or "latent image") is formed on that surface by exposure through a colored transparency. This latent image is then developed with a liquid developer composition of a first color, i.e., comprising toner formulated with a first colorant, typically yellow. The photoconductive layer is then discharged, either optically or non-optically, i.e., via a corona. These steps are then repeated in sequence with developer compositions of different colors, typically (in order) magenta, cyan and black, at which point the developed image may, if desired, be transferred to another substrate, e.g., paper. Using the toner and developer compositions of the invention, it is possible to carry out the aforementioned sequence of steps without any intermediate processing steps, i.e., rinsing, drying or the like. These steps have typically been necessary in the prior art, as exemplified by the Alexandrovich et al. patent, cited supra, to address the problem of image staining. Because of the various features of the current invention which assist in overcoming the problem of image staining, however, it is no longer necessary to carry out the time-consuming and unwieldy processes taught by the prior art.

As illustrated by the accompanying figures, the above disclosure and the examples which follow, the compositions and processes of the invention address and overcome a number of significant obstacles heretofore present in color electrophotographic image development.

Examples 1–3 illustrate the preparation of three different charge directors for use in conjunction with the toner and developer compositions of the invention.

EXAMPLE 1

The following abbreviations are used in this and the following two examples:

"DIPSH" = 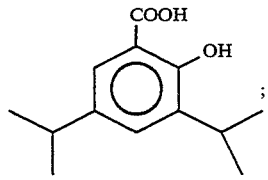

;

"DIPS" = 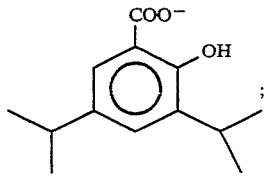

;

"OCT" = $C_7H_{15}COO$; "TC" = $C_9H_{19}COO$.

The reactions of this example may be schematically represented by the following equations (a) and (b):

$$HOAl(OCT)+DIPSH \rightarrow Al(OCT)_2DIPS+H_2O; \quad (a)$$

and $$Al(OCT)_2DIPS+Al(DIPS)_3 \rightarrow 2\ Al(DIPS)_2OCT. \quad (b)$$

Procedurally, 1.65 g (0.005 mol) aluminum octoate (Witco Chemical, approximately 97% pure; washed prior to use with acetone to remove excess octanoic acid) and 1.1 g (0.005 mol) DIPSH were placed into 200 g of Isopar G (Exxon). The resultant suspension was heated to 140° C. for 1 hr resulting in a faintly opalescent solution. The solution was cooled and diluted to 500 g with Isopar G. To this solution was added 3.4 g of $Al(DIPS)_3$ and stirred to effect dissolution. The resultant solution contained $2.0\times10^{-5}$ mol/g of aluminum.

EXAMPLE 2

The reaction of this example may be schematically represented by the following equation (c):

$$HOAl(OCT)_2+2\ DIPSH \rightarrow Al(DIPS)_2OCT+H_2O+HOCT. \quad (c)$$

Procedurally, 1.70 g (0.005 mol) aluminum octoate (Witco) and 2.2 g (0.01 mol) DIPSH were charged into 200 g Isopar G and heated, with stirring, to 160° C. for 1 hr to give a faintly opalescent solution. Dilution of 8 g of the solution to 200 g resulted in a solution containing $1\times10^{-6}$ mol/g of aluminum.

By employing equimolar quantities of reactants, charge directors of the type $Al(DIPS)(OCT)_2$ were produced.

EXAMPLE 3

The reaction of this example may be schematically represented by the following equation (d):

$$2Al(DIPS)_3+Al(TC)_3 \rightarrow 3\ Al(TC)(DIPS)_2. \quad (d)$$

The $Al(DIPS)_3$ (1.38 g; $2\times10^{-3}$ mol) and 13.8 g of a 4% solution $Al(TC)_3$ ($1\times10^{-3}$ mol; supplied by Mooney Chemical) were dissolved in 300 g of Isopar G. The resultant solution was set aside for 24 hr before use and contained $1\times10^{-5}$ mol/g aluminum, Examples 4 and 5 illustrate the preparation and use of toner and developer compositions containing an incompatible phase (Examples 4 and 5) and an antistain agent (Example 5).

EXAMPLE 4

A series of dyed toners were prepared using RJ 100 or 101 (styrene-allyl alcohol copolymers, manufactured by Monsanto Corp.) by dissolution of the dye (Savinyl Blue BLS) on a two-roll mill at 140° C. The resultant dyed polymer was comminuted in a hammer to give particles approximately 30 microns in diameter. These particles were then submitted to liquid attrition in a Union Process 01 apparatus. The particle size and particle surface area in these dispersions was monitored in a Horiba particle analyzer. The surface area of the toner particles reached a maximum of 1.5 to 3 $m^2/g$ even after attrition times of as long as 20 to 40 hours. Microscopic examination revealed essentially spherical toner particles which were highly aggregated.

In another series of experiments, toners based on blends of RJ 100 or 101 with 3–30% carnauba wax were prepared as described in the preceding paragraph. The liquid attrition proceeded with marked rapidity. After 2–4 hours of liquid attrition in Isopar H (Exxon), surface areas of 3 to 6 $m^2/g$ were readily achieved. Microscopic examination revealed essentially mono-dispersed shard-like particles averaging 1.5 to 2 microns in diameter.

Additional toners with and without carnauba wax were prepared as described above, substituting the resins AC 201,540, and 580 (Allied Chemical Corp., Morristown, N.J.) for RJ 100 and 101, and using a variety of pigments, including Heliogen blue.

Liquid developer compositions were then prepared by dispersing each of the toner compositions described above in Isopar G (Exxon), charge directed with basic barium petrolate, and evaluated using a Savin 870 color copier. Regardless of the resin or colorant used, images produced from the toner particles manufactured with wax exhibited excellent edge acuity and resolution. Images produced from the toner particles containing no wax were by contrast very grainy and exhibited irregular edges.

EXAMPLE 5

A liquid developer composition was prepared by melting resin (175 g AC540, an ethylene-acrylic copolymer manufactured by Allied Chemical Corp., Morristown, N.J.; and 175 g AC201A, an ionomer of AC580, also manufactured by Allied Chemical Corp.) and admixing therewith the following: 62.8 g Sico Fast Yellow DN55, 25 g WB11, a cationic wax dispersant (Petrolite), and 25 g carnauba wax. The resultant mixture was comminuted by hammer milling, followed by liquid attrition in Isopar H (Exxon) using a Union Process 01 apparatus. The particle surface area in these dispersions was monitored in a Horiba particle analyzer. The surface area of the toner particles averaged approximately 4.3 $m^2/g$. A 2% developer composition was prepared by dispersing these toner particles in 130 g Isopar H (Exxon). Magenta, cyan and black developer compositions were prepared in this way, as well.

Liquid developer compositions containing an antistatic agent were then prepared as follows. Resin, dyes, WB11 and wax were admixed as described above, except that 15 g Tween 80 (ICI) were incorporated into the admixture. Comminution and attrition were carried out as in the preceding section, and 2% developer compositions were prepared with Isopar H.

Series of tests were then conducted using the two types of developer compositions, i.e., with and without the antistatic agent Tween 80, in consecutive color toning. Photoconductive substrates (ZnO) were charged, exposed and developed in untoned areas using each of the two types of developer compositions, in the four-color development sequence yellow, magenta, cyan and black. The composition without the antistatic agent resulted in a noticeable degree of image staining, while the composition containing the antistatic agent resulted in virtually no noticeable image staining.

Examples 6–26 describe preparation of ion exchange toners and liquid developer compositions containing those toners.

EXAMPLE 6

Toner was prepared by melting 120 g AC 201 resin (Allied Chemical) onto a two-roll mill with differentially heated rollers. The rear roller was maintained at about 100° C. to 120° C. while the front roller was heated to about 70° C. Pigment (Novoperm Yellow FGL, 60 g) was added and allowed to mix for 0.5 to 1.0 hr until dispersed. AC 143 resin (120 g; Allied Chemical) was added and allowed to blend for approximately 0.5 hr, after which time the remainder of the ingredients—10 g carnauba wax, 10 g salicylic acid, and 10 g Brij 98 antistain (ICI America)—were blended into the mixture. The mixture was removed from the mill and comminuted in a hammer mill to produce a 15-to-30 micron powder.

The powder so obtained was charged into a Union Process 1-5 attritor containing 0.1875" hardened steel balls and 1000 g of Isopar G (Exxon). The rotor speed was set at 250 rpm and the attritor was cooled to 30° C. Surface area and particle size were monitored using an Horiba CAPA-500 centrifugal particle analyzer (Horiba Instruments, Inc., Irvine, Calif.). After 4 to 6 hr, the surface area of the dispersed phase was approximately 5 $m^2/g$. The developer was discharged and diluted to 10% w/w with Isopar G.

To provide the final liquid developer composition, a 40 g sample of this dispersion was diluted to 400 g with Isopar G, followed by addition of 4 g of a charge director as prepared in Example 2, containing approximately $1\times10^{-6}$ mole/g aluminum salt. This positively charged developer produced sharp (20–25 line prs/mm), dense (1.4–2.3 reflection density) background-free images on zinc oxide and on OPC. Moreover, the developer exhibited excellent long-term stability.

The same liquid developer was converted to a negatively charged material with lecithin and with basic Barium Petronate metal salts of selected fatty acids. Dense, sharp images were prepared employing a standard Savin 870 photocopier.

EXAMPLE 7

The procedure of Example 6 was followed identically, except that two pigments were used: 60 g Hostaperm Red E5B-02 and 1 g of Hostaperm Violet RL-E5. The results obtained were substantially the same as those reported for the toner and developer compositions of Example 6.

EXAMPLE 8

The procedure of Example 6 was followed identically, except that two pigments were used: 50 g Heliogen Blue L7080, 4.5 g Heliogen Green 8730 and 1.3 g Sicofast D 1155. The results obtained were substantially the same as those reported for the toner and developer compositions of Example 6.

Figure 3:
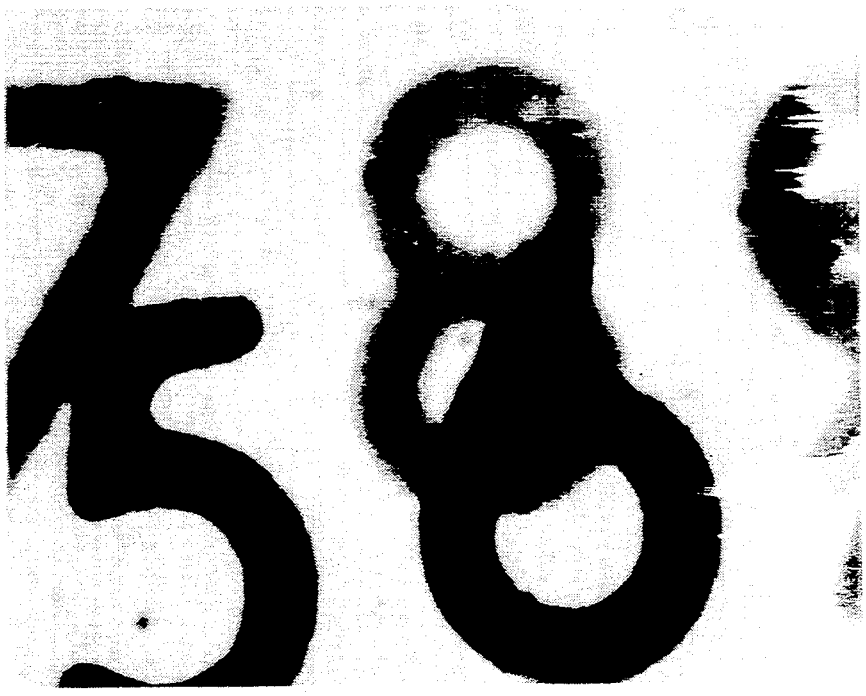
FIGS. 3, 4 and 5 are photomicrographs of images obtained with the compositions of Examples 8, 9 and 10.

The developer of this system was used to overtone the image obtained with the developer of Example 7; a photomicrograph of the resulting image is shown in FIG. 3. As may be seen from that Figure, virtually no image staining is apparent.

EXAMPLE 9

Figure 4:
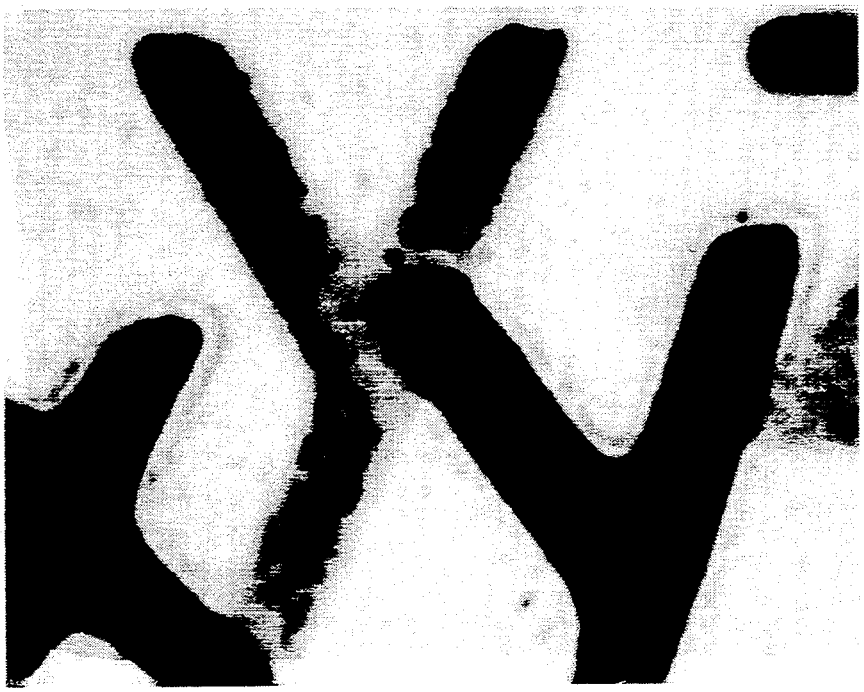

The procedure of Example 8 was followed, except that the antistain agent was omitted from the toner composition. The developer of this sytem was used to overtone the image obtained with the developer of Example 7; as may be seen in FIG. 4, the photomicrograph of the resulting image, image staining is quite apparent.

EXAMPLE 10

Figure 5:
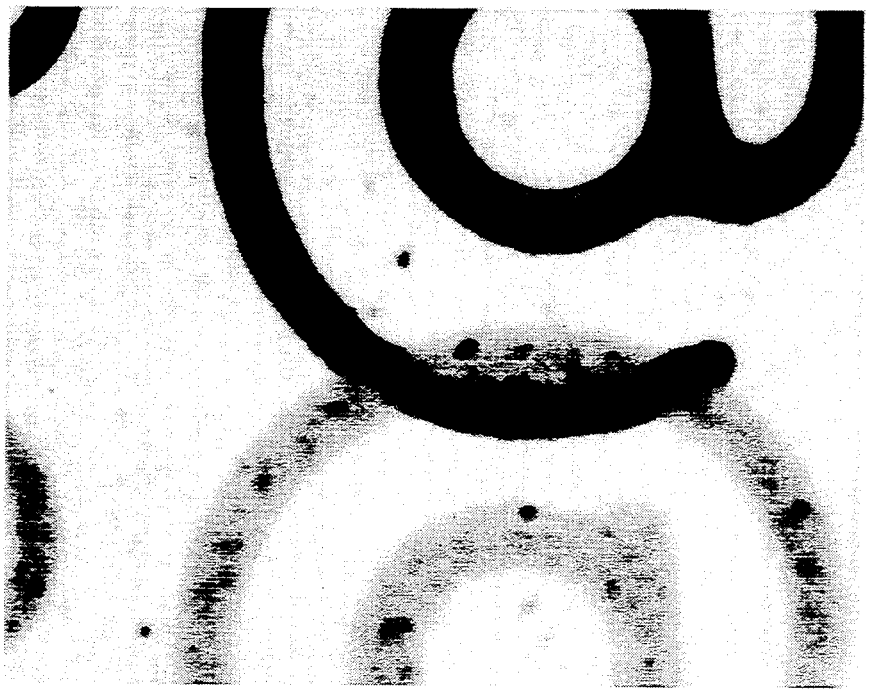

The procedure of Example 8 was followed, except that an excess of charge director was incorporated into the developer composition. The developer of this system was used to overtone the image obtained with the developer of Example 7; as may be deduced from the photomicrograph of FIG. 5, the high continuous phase conductivity of the composition gave rise to some distortion at the interface of the two color images.

EXAMPLE 11

The procedure of Example 8 was followed, except that salicylic acid was omitted from the developer composition. The developer of this system was used to overtone the image obtained with the developer of Example 7; a photomicrograph of the resultant image was similar to that obtained in the preceding example, i.e., the high continuous phase conductivity of the composition gave rise to some distortion at the interface of the two color images.

EXAMPLE 12

The procedure of Example 6 was followed identically, except that Brij 35 (ICI America) was substituted for Brij 98 as the antistain agent. The results obtained were substantially the same as those reported for the toner and developer compositions of Example 6.

EXAMPLE 13

The procedure of Example 6 was followed identically, except that AC 540 resin (Allied Chemical) was substituted for AC 143. The results obtained were substantially the same as those reported for the toner and developer compositions of Example 6.

EXAMPLE 14

The procedure of Example 6 was followed identically, except that AC 580 resin (Allied Chemical) was substituted for AC 143. The results obtained were substantially the same as those reported for the toner and developer compositions of Example 6.

EXAMPLE 15 a.) The procedure of Example 6 was followed identically, except that ACX 251 resin (Allied Chemical), a neutral resin of an ethylene-vinyl alcohol copolymer, was substituted for AC 201 and AC 143. The results obtained were substantially the same as those reported for the toner and developer compositions of Example 6.

b.) The procedure of Example 7 was followed identically, except that ACX 251 resin was substituted for AC 201 and AC 143. The results obtained were substantially the same as those obtained in (a).

c.) The procedure of Example 8 was followed identically, except that ACX 251 resin was substituted for AC 201 and AC 143. The results obtained were substantially the same as those obtained in (a) and (b).

EXAMPLE 16

The procedure of Example 6 was followed identically, except that Elvax 5120 was substituted for AC 143. The results obtained were substantially the same as those reported for the toner and developer compositions of Example 6.

EXAMPLE 17

The procedure of Example 6 was followed identically, except that 60 g Mogul L was substituted for Novoperm Yellow FGL. The results obtained were substantially the same as those reported for the toner and developer compositions of Example 6.

EXAMPLE 18

The procedure of Example 6 was followed identically, except that RJ 100 or RJ 101 resin (see Example 4) was substituted for AC 201 and AC 143. The results obtained were substantially the same as those reported for the toner and developer compositions of Example 6.

EXAMPLE 19

The procedure of Example 6 was followed identically, except that 3-hydroxy-2-naphthoic acid was substituted for salicylic acid. The results obtained were substantially the same as those reported for the toner and developer compositions of Example 6.

EXAMPLE 20

The procedure of Example 6 was followed identically, except that 5-amino-salicylic acid was substituted for salicylic acid. The results obtained were substantially the same as those reported for the toner and developer compositions of Example 6.

EXAMPLE 21

The procedure of Example 6 was followed identically, except that 5-chloro-salicylic acid was substituted for salicylic acid. The results obtained were substantially the same as those reported for the toner and developer compositions of Example 6.

EXAMPLE 22

The procedure of Example 6 was followed identically, except that Carbowax 1000 (Example 22a) and 2000 (Example 22b) were substituted for Brij 98 as the antistain agent. The results obtained were substantially the same as those reported for the toner and developer compositions of Example 6.

EXAMPLE 23

The procedure of Example 6 was followed identically, except that the charge director used was that prepared in Example 1. The results obtained were substantially the same as those reported for the toner and developer compositions of Example 6.

EXAMPLE 24

The procedure of Example 6 was followed identically, except that the charge director used was that prepared in Example 3. The results obtained were substantially the same as those reported for the toner and developer compositions of Example 6.

EXAMPLE 25

The procedure of Example 6 was followed identically, except that an extruder was used to manufacture the toner. The results obtained were substantially the same as those reported for the toner and developer compositions of Example 6.

EXAMPLE 26

The procedure of Example 6 was followed identically, except that a planetary mixer was used to manufacture the toner. The results obtained were substantially the same as those reported for the toner and developer compositions of Example 6.

It is to be understood that while the invention has been described in conjunction with the preferred specific embodiments thereof, that the foregoing description including the examples are intended to illustrate and not limit the scope of the invention. Other aspects, advantages and modifications within the scope of the invention will be apparent to those skilled in the art to which the invention pertains.

I claim:

1. A process for making an electrophotographic liquid developer composition, which comprises:

dispersing, in an electrically insulating carrier liquid, a toner comprised of (a) a charge control agent which is a metal salt and (b) particles comprising a colored resinous phase having specific surface ion exchange sites available for complexation with said metal salt, said sites being comprised of a monomeric compound physically admixed in said resinous phase, wherein said ion exchange sites and said charge control agent are selected so that virtually all of the charge control agent in the developer composition is associated with the particles.

2. The process of claim 1, wherein the charge control agent is effective to provide a positive toner.

3. The process of claim 1, wherein said ion exchange sites comprise the hydroxy and carboxy moieties of a first ortho-hydroxy aromatic acid.

4. The process of claim 3, wherein said charge control agent comprises a compound of the formula $(RO^-)_xM^{+n}(AA^-)_y$ in which:

M is a metal atom;

AA− represents the anion of a second ortho-hydroxy aromatic acid;

R is selected from the group consisting of R'CO—, $C_1$–$C_{15}$ alkyl, and a 1–3 ring aryl moiety optionally substituted with 1–6 lower alkyl substituents, where R' is $C_1$–$C_{14}$ alkyl;

n is 2, 3 or 4; and x and y are integers the sum of which is equal to n.

5. The process of claim 4, wherein M is aluminum, AA− is diisopropyl salicylate, R is $C_{10}H_{21}CO$—, n is 3, x is 1 or 2, and y is 1 or 2.

6. The process of claim 1, which further comprises dispersing an antistain agent into said composition.

7. The process of claim 6, wherein said antistain agent is substantially insoluble in said insulating carrier liquid and in said resinous phase.

8. The process of claim 7, wherein said antistain agent is selected from the group consisting of: (a) ethoxylated derivatives of fatty acids, alcohols and amides; (b) alkyl phosphates and phosphonates and metal salts thereof; (c) homopolymers of ethylene oxide; and (d) copolymers of ethylene and propylene oxide.

9. The process of claim 6, which further comprises incorporating a separate, solid incompatible phase into the toner particles prior to said dispersing.

10. The process of claim 9, wherein the incompatible phase comprises a wax.

11. The process of claim 1, which further comprises incorporating a separate, solid incompatible phase into the toner particles prior to said dispersing.

12. The process of claim 11, wherein the incompatible phase comprises a wax.

13. A composition as in claim 1 and wherein said resinous phase is oleophobic and is prepared by admixing a resin with said compound at temperature in the range of about 100° C. and 200° C. followed by comminuting the admixture.

14. In a process for developing an electrostatic charge pattern using consecutive multicolor image development, comprising: (a) forming an initial electrostatic charge pattern using consecutive multicolor image development, comprising: (a) forming an initial electrostatic charge pattern on a substrate and developing the initial pattern with a liquid developer composition comprising toner of a resinous phase containing a first colorant dispersed in an insulating carrier liquid; and (b) forming a second electrostatic charge pattern on the substrate and developing the second pattern with a liquid developer composition comprising toner of a resinous phase containing a second colorant dispersed in an insulating carrier liquid, the improvement which comprises:

employing as said toner: (a) a charge control agent which is a metal salt and (b) particles comprising a colored resinous phase having specific surface ion exchange sites available for complexation with said metal salt, said sites being comprised of a monomeric compound physically admixed in said resinous phase, wherein said ion exchange sites and said charge control agent are selected so that virtually all of the charge control agent in the developer composition is associated with the particles.

15. The process of claim 14, further comprising repeating steps (a) and (b) with third and fourth colorants to provide a developed image.

16. The process of claim 15, further including (d) transferring the developed image provided in step (c) to a surface of a selected substrate so as to give rise to an electrophotographic color print thereon.

17. The process of claim 16, wherein said metal salt is divalent, trivalent or tetravalent.

18. The process of claim 17, wherein said metal salt is trivalent.

19. The process of claim 18, wherein said metal salt is aluminum.

20. The process of claim 16, wherein said ion exchange sites comprise the hydroxy and carboxy moieties of a first ortho-hydroxy aromatic acid.

21. The process of claim 20, wherein said charge control agent comprises a metal salt of a second ortho-hydroxy aromatic acid.

22. The process of claim 16, wherein said ion exchange sites comprise the hydroxy and carboxy moieties of a first ortho-hydroxy aromatic acid, said charge control agent comprises a metal salt of a second ortho-hydroxy aromatic acid and said resinous phase is prepared by admixing a resin with said compound at temperature in the range of about 100° C. and 200° C. followed by comminuting the admixture.

23. The process of claim 22, wherein said charge control agent has the formula $(RO^-)_xM^{+n}(AA^-)_y$ in which:

M is a metal atom;

AA− represents the anion of said second ortho-hydroxy aromatic acid;

R is selected from the group consisting of R'CO—, $C_1$–$C_{15}$ alkyl, and a 1–3 ring aryl moiety optionally substituted with 1–6 lower alkyl substituents, where R' is $C_1$–$C_{14}$ alkyl;

n is 2, 3 or 4; and x and y are integers the sum of which is equal to n.

24. The process of claim 23, wherein M is aluminum, AA− is diisopropyl salicylate (DIPS), R is $C_{10}H_{21}CO$—, n is 3, x is 1 or 2, and y is 1 or 2.

25. The process of claim 16, wherein said toner additionally contain an incompatible phase.

26. The process of claim 25, wherein said incompatible phase comprises a microcrystalline wax.

27. The process of claim 26, wherein said microcrystalline wax comprises carnauba wax.

28. The process of claim 14, wherein said liquid developer composition further comprises an antistain agent which is substantially insoluble in said insulating carrier liquid and in said resinous phase.

29. The process of claim 28, wherein said antistain agent is selected from the group consisting of: (a) ethoxylated derivatives of fatty acids, alcohols and amides; (b) alkyl phosphates and phosphonates and metal salts thereof; (c) homopolymers of ethylene oxide; and (d) copolymers of ethylene and propylene oxide.

30. A composition as in claim 14 and wherein said resinous phase is oleophobic and is prepared by admixing a resin with said compound at temperature in the range of about 100° C. and 200° C. followed by comminuting the admixture.

31. An electrophotographic liquid developer composition comprising, dispersed in an electrically insulating carrier liquid, (a) a charge control agent comprising a metal salt and (b) particles comprising a colored resinous phase having specific surface ion exchange sites available for complexation with the metal salt, said sites being comprised of a monomeric compound physically admixed in said resinous phase, and wherein the ion exchange sites are selected relative to the charge control agent so that the equilibrium of complexation there-between is such that virtually all of the charge control agent is associated with the particles.

32. A composition as in claim 31 and wherein said metal salt is divalent, trivalent or tetravalent.

33. A composition as in claim 32 and wherein said metal salt is a trivalent metal salt of an ortho-hydroxy aromatic acid.

34. A composition as in claim 32 and wherein said charge control agent has the formula $(RO^-)_xM^{+n}(AA^-)_y$ in which:

M is a metal atom;

$AA^-$ represents an ortho-hydroxy aromatic acid anion

R is selected from the group consisting of R'CO—, $C_1$–$C_{15}$ alkyl, and a 1–3 ring aryl moiety optionally substituted with 1–6 lower alkyl substituents, where R' is $C_1$–$C_{14}$ alkyl;

n is 2, 3, or 4; and x and y are integers the sum of which is equal to n.

35. The composition as in claim 34 and wherein M is aluminum, $AA^-$ is diisopropyl salicylate, R is $C_{10}H_{21}CO$—, n is 3, x is 1 or 2 and y is 1 or 2.

36. A composition as in claim 32 and wherein said ion exchange sites comprise the hydroxy and carboxy moieties of a first ortho-hydroxy aromatic acid.

37. A composition as in claim 36 and wherein said metal salt is divalent, trivalent or tetravalent.

38. A composition as in claim 36 and wherein said charge control agent comprises a metal salt of a second ortho-hydroxy aromatic acid.

39. A composition as in claim 38 and wherein said charge control agent has the formula $(RO^-)_xM^{+n}(AA^-)_y$ in which:

M is a metal atom;

$AA^-$ represents an ortho-hydroxy aromatic acid anion

R is selected from the group consisting of R'CO—, $C_1$–$C_{15}$ alkyl, and a 1–3 ring aryl moiety optionally substituted with 1–6 lower alkyl substituents, where R' is $C_1$–$C_{14}$ alkyl;

n is 2, 3, or 4; and x and y are integers the sum of which is equal to n.

40. The composition as in claim 39 and wherein M is aluminum, $AA^-$ is diisopropyl salicylate, R is $C_{10}H_{21}CO$—, n is 3, x is 1 or 2 and y is 1 or 2.

41. A composition as in claim 38 and wherein the first and the second ortho-hydroxy aromatic acids are independently selected from the group consisting of salicylic acid and derivatives thereof.

42. A composition as in claim 38 and wherein said resinous phase is prepared by admixing a resin with said compound at temperature in the range of about 100° C. and 200° C. followed by comminuting the admixture.

43. A composition as in claim 36 and including therein an antistain agent substantially insoluble in said insulating carrier and in said resin phase.

44. A composition as in claim 43 and including therein an antistain agent selected from the group consisting of (a) ethoxylated derivatives of fatty acids, alcohols and amides; (b) alkyl phosphates and phosphonates and metal salts thereof; (c) homopolymers of ethylene oxide; and (d) copolymers of ethylene and propylene oxide.

45. A composition as in claim 43 and wherein said particles additionally contain an incompatible phase comprising wax.

46. A composition as in claim 31 and including therein an antistain agent.

47. A composition as in claim 46 and wherein said particles additionally contain an incompatible phase.

48. A composition as in claim 31 and wherein said resinous phase is oleophobic and is prepared by admixing a resin with said compound at temperature in the range of about 100° C. and 200° C. followed by comminuting the admixture.

49. An electrophotographic image constituting a composite color print, comprising, deposited on a substrate in a predetermined pattern, a liquid developer composition comprised of (a) a charge control agent which is a metal salt, and (b) particles comprising a colored resinous phase having specific surface ion exchange sites available for complexation with said metal salt, said ion exchange sites being comprised of a monomeric compound physically admixed in said resinous phase.

* * * * *